US005628556A

United States Patent [19]

Hrabar et al.

[11] Patent Number: 5,628,556

[45] Date of Patent: May 13, 1997

[54] ILLUMINATING NUT DRIVER

[76] Inventors: Kristin Hrabar; Frank Hrabar, Jr., both of 127A Aberdeen Rd., Aberdeen, N.J. 07747

[21] Appl. No.: 577,689

[22] Filed: Dec. 22, 1995

[51] Int. Cl.[6] ..... B25B 23/18

[52] U.S. Cl. ..... 362/119; 362/32; 362/120

[58] Field of Search ..... 362/26, 32, 109, 362/119, 120; 7/138, 165; 81/121, 900

[56] References Cited

U.S. PATENT DOCUMENTS 2,706,769 4/1955 Cook ..... 362/120

3,185,832 5/1965 Nagamori ..... 362/120

FOREIGN PATENT DOCUMENTS 958768 5/1964 United Kingdom ..... 362/120

*Primary Examiner*—Y. My Quach

[57] ABSTRACT

A handle that has a distal end with a threaded interior, a proximal end with an opening that has a keyway, and a middle portion. Included is a driver shaft that has a nut driver at a first end and a key member at a second end. The key member couples the keyway of the handle to lock the shaft within. A lamp receptacle with a lamp, is positioned within the handle near the proximal end. A conductive strip is positioned along an interior of the handle and the receptacle. The strip is in contact with the lamp. Lastly, an end cap that has a switch with a switch button is capable of threadable engagement with the threaded interior of the distal end of the handle. The end cap is capable of encapsulating a battery within the handle. The switch has a contact strip in electrical contact with the contact strip within the handle. Electrical contact between the strips allows the battery and the lamp to be in electrical contact for illumination of the lamp.

4 Claims, 3 Drawing Sheets

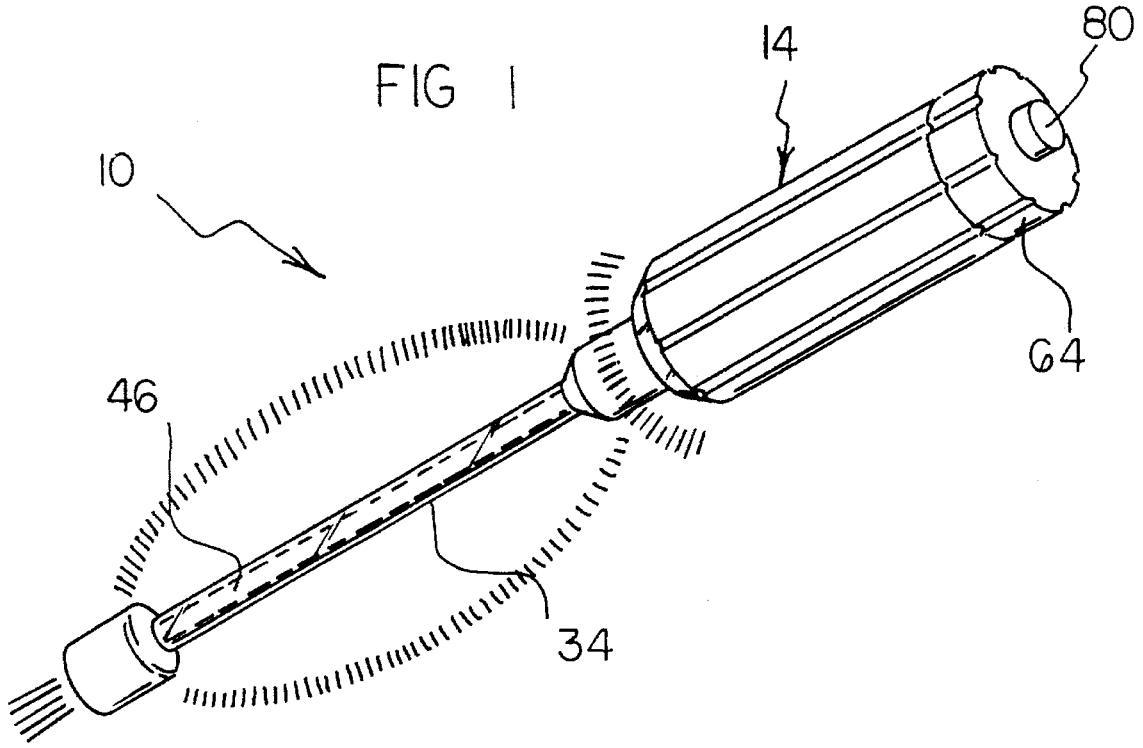
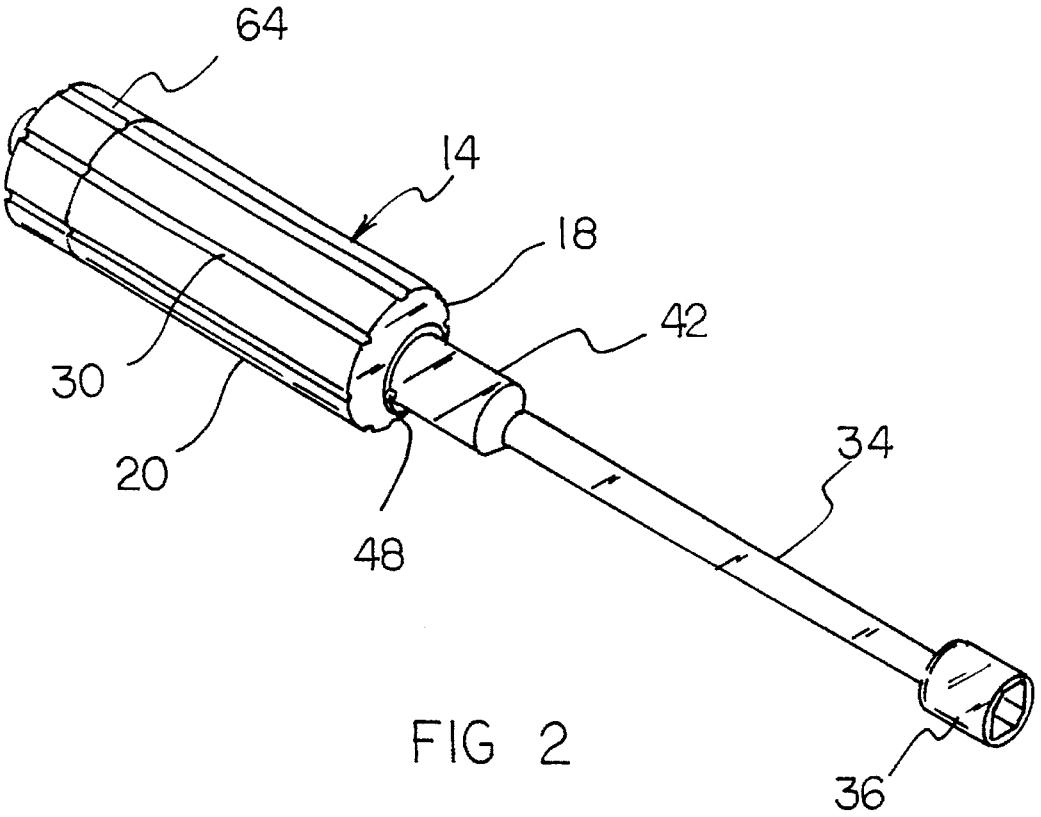
FIG 2

FIG 3
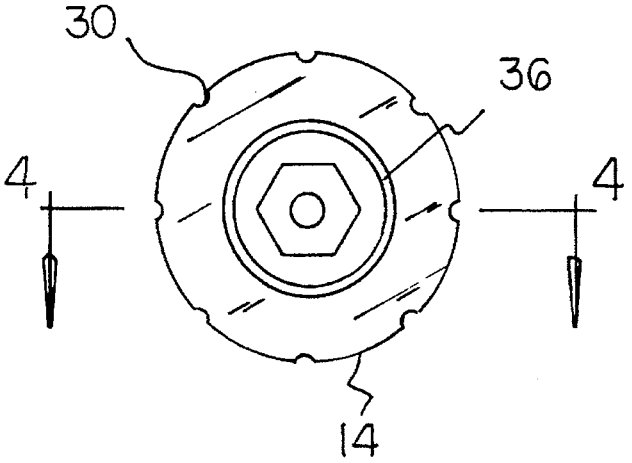
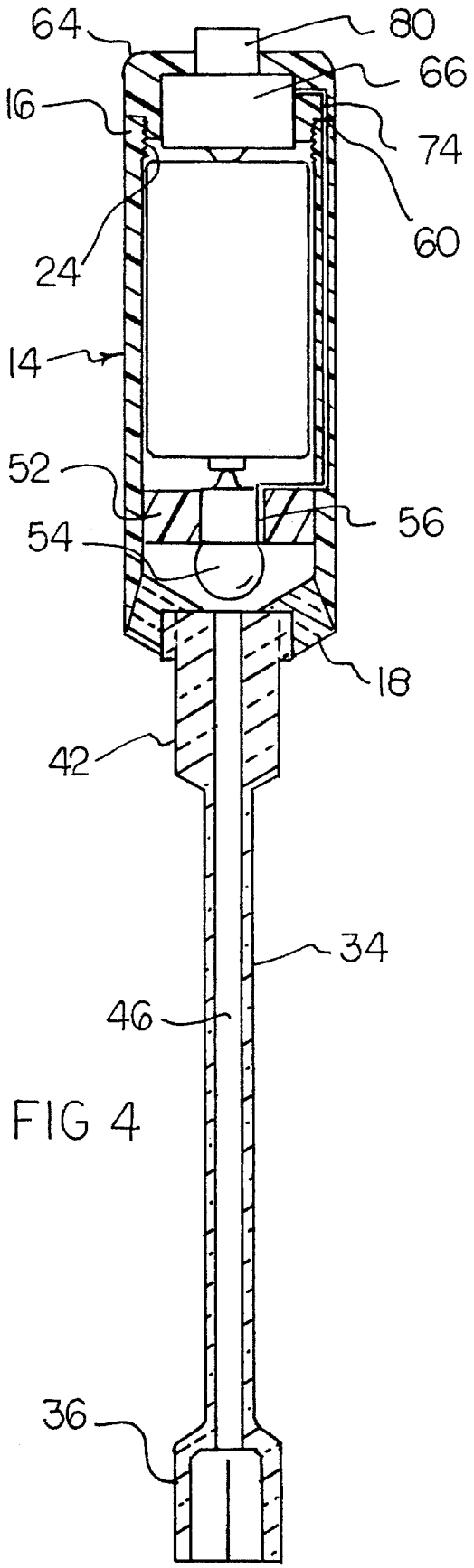
FIG 4

ILLUMINATING NUT DRIVER

BACKGROUND OF THE INVENTION

1. Field of the Invention

The present invention relates to an illuminating nut driver and more particularly pertains to providing a light source that is positioned within the handle of a nut driver, such that the light is transferred through a composite nut driver shaft.

2. Description of the Prior Art

The use of light emitting handles is known in the prior art. More specifically, light emitting handles heretofore devised and utilized for the purpose of lighting the work area are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,051,876 to Norman discloses a compound hand tool with a screwdriver. U.S. Pat. No. 4,348,715 to Christiensen and Horibata discloses a lighted tool holder. U.S. Pat. No. 4,283,757 to Malbandian and Sullivan discloses an illuminated screwdriver. U.S. Pat. No. 5,168,780 to Van Gennep discloses a tool driver with a detachable handle having a light. U.S. Pat. No. 5,063,796 to Gennep discloses a tool driver with a handle. Lastly, U.S. Pat. No. 5,369,555 to McKaian and Fritze discloses a light emitting screwdriver.

While these devices fulfill their respective, particular objectives and requirements, the aforementioned patents do not describe illuminating nut driver that allows the user of the device to be provided with illumination directed toward the work area where a nut will be driven or removed.

In this respect, the illuminating nut driver according to the present invention substantially departs from the conventional concepts and designs of the prior art, and in doing so provides an apparatus primarily developed for the purpose of providing a light source that is positioned within the handle of a nut driver, such that the light is transferred through a composite nut driver shaft.

Therefore, it can be appreciated that there exists a continuing need for a new and improved illuminating nut driver which can be used for providing a light source that is positioned within the handle of a nut driver, such that the light is transferred through a composite nut driver shaft. In this regard, the present invention substantially fulfills this need.

SUMMARY OF THE INVENTION

In view of the foregoing disadvantages inherent in the known types of light emitting handles now present in the prior art, the present invention provides an improved illuminating nut driver. As such, the general purpose of the present invention, which will be described subsequently in greater detail, is to provide a new and improved illuminating nut driver and method which has all the advantages of the prior art and none of the disadvantages.

To attain this, the present invention essentially comprises a hollow torque handle that has a distal end, a proximal end and a middle portion. The distal end has a threaded interior. The proximal end has an opening with a keyway. The torque handle has a circular cross section. The handle has a plurality of linearly extending grooves for enhancing the gripping capabilities of the handle. Also, a hollow driver shaft is provided. The shaft has a cylindrical nut driver at a first end and a key member at a second end. The nut driver and the key member are integral with the shaft. The key member of the driver shaft couples with the keyway of the torque handle to allow the shaft to be locked within the handle. The driver shaft, once locked within the handle, is axially relative to the handle for use. A lamp receptacle is positioned within the torque handle near the proximal end. The lamp receptacle has a lamp that is detachably mounted within. The lamp receptacle has a conductive strip positionable therein and adjacent the lamp. The conductive strip extends along an interior of the torque handle with a contact end at the distal end of the handle. A generally cylindrical end cap, with a switch, is provided. The end cap is capable of threadable engagement with the threaded interior of the distal end of the handle. The switch has a contact tip projecting from a bottom portion of the cap. The switch has a contact strip that extends therefrom and into the end cap. The contact strip of the switch has a contact end along a shell of the cap. The end cap is threadably coupled with the handle. Coupling the cap and the handle allows the contact tip to be in contact with a battery positioned within the torque handle. Lastly, the contact strip of the cap is flush with the contact end of the contact strip of the handle. The contact strip of the cap, when in contact with the contact strip of the handle, allows passage of a current through to the lamp. Turnin when the switch is turned on by pushing a switch button. The switch button, when pushed, allows the battery and the lamp to be in electrical contact for illumination of the lamp. Whereby, light passes from the handle down the driver shaft and through the nut driver.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminating nut driver which has all of the advantages of the prior art light emitting handles and none of the disadvantages.

It is another object of the present invention to provide a new and improved illuminating nut driver which may be easily and efficiently manufactured and marketed.

It is further object of the present invention to provide a new and improved illuminating nut driver which is of durable and reliable constructions.

An even further object of the present invention is to provide a new and improved illuminating nut driver which is susceptible of a low cost of manufacture with regard to both materials and labor, and which accordingly is then susceptible of low prices of sale to the consuming public, thereby making such illuminating nut driver economically available to the buying public.

Still yet another object of the present invention is to provide a new and improved illuminating nut driver which provides in the apparatuses and methods of the prior art some of the advantages thereof, while simultaneously overcoming some of the disadvantages normally associated therewith.

Even still another object of the present invention is to provide an illuminating nut driver for providing a light source that is positioned within the handle of a nut driver, such that the light is transferred through a composite nut driver shaft.

Lastly, it is an object of the present invention to provide a new and improved handle that has a distal end with a threaded interior, a proximal end with an opening that has a keyway, and a middle portion. Included is a driver shaft that has a nut driver at a first end and a key member at a second end. The key member is capable of coupling the keyway of the handle to lock that shaft within. A lamp receptacle with a lamp detachably mounted, is positioned within the handle near the proximal end. A conductive strip is positioned along an interior of the handle and the receptacle. The strip is in contact with the lamp. Lastly, an end cap that has a switch with a switch button is capable of threadable engagement with the threaded interior of the distal end of the handle. The end cap is capable of encapsulating a battery within the handle. The switch has a contact strip that is in electrical contact with the contact strip within the handle. Electrical contact between the strips allows the battery and the lamp to be in electrical contact for illumination of the lamp.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the illuminating nut driver constructed in accordance with the principles of the present invention.

FIG. 2 is an isometric view of the present invention as shown in FIG. 1.

FIG. 3 is a bottom plan view of the present invention.

FIG. 4 is a cross sectional view of the present invention taken along line 4—4 of FIG. 3.

The same reference numerals refer to the same parts through the various Figures.

DESCRIPTION OF THE PREFERRED EMBODIMENT

Figure 5:
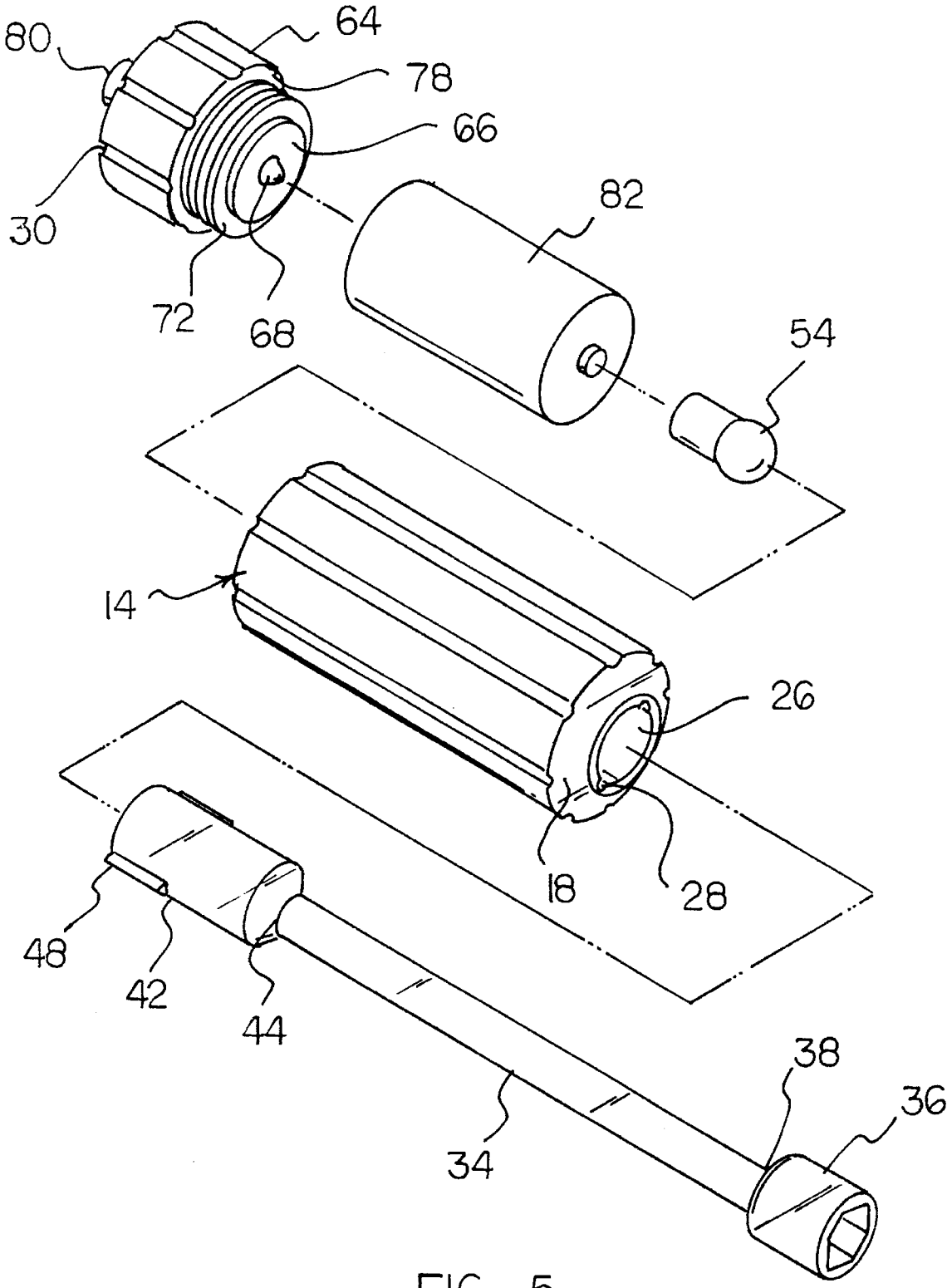
FIG. 5 is an exploded view of the present invention depicting the operable components.

With reference now to the drawings, and in particular to FIG. 1 thereof, the preferred embodiment of the new and improved illuminating nut driver embodying the principles and concepts of the present invention and generally designated by the reference numeral 10 will be described.

The present invention, the illuminating nut driver 10 is comprised of a plurality of components. Such components in their broadest context include a handle, a driver shaft and light mechanisms. Such components are individually configured and correlated with respect to each other so as to attain the desired objective.

Specifically, the present invention includes a hollow torque handle 14 that has a distal end 16, a proximal end 18 and a middle portion 20. The handle is made of a rigid plastic, preferably, polycarbinate. Polycarbinate is used because of its durability and strength under torsional pressure. The plastic used may be clear or have a variety of colors. As shown in FIG. 4, the distal end has a threaded interior 24. The proximal end, as seen in FIG. 5, has an opening 26 with a keyway 28. The torque handle has a circular cross section. The handle has a plurality of linearly extending grooves 30, as shown in FIG. 3, for enhancing the gripping capabilities of the handle. The grooves increase the frictional gripping between the handle and the hand of a user.

As best illustrated in FIG. 5, a hollow driver shaft 34 is provided. The shaft has a cylindrical nut driver 36 at a first end 38 and a key member 42 at a second end 44. The nut driver and the key member are integral with the shaft and formed of metal or plastic. The plastic used to make the driver shaft is identical to the plastic used in making the handle. The shaft has a passage way 46 that extends the length of the driver shaft. The key member of the driver shaft has a key 48 that is coupled with the keyway 28 of the torque handle 14 and locks the driver shaft therein. The driver shaft, having been locked within the torque handle, is axially relative thereto for use.

Also, a lamp receptacle 52 is positioned within the torque handle 14 near the proximal end 18. The lamp receptacle, as seen in FIG. 4, has a lamp 54 that is detachably mounted within. The lamp receptacle is fixedly attached to the handle and formed of an identical plastic. The lamp is any commercially available lamp structured for use in a flashlight. The lamp receptacle has a conductive strip 56 that is positioned within and in contact with the lamp. The conductive strip is aluminum and extends along an interior of the torque handle with a contact end 60 at the distal end 16 of the handle. The contact end may be seen along a surface edge of the distal end.

Additionally, a generally cylindrical end cap 64 is included. The end cap has a switch 66 that is contained within. The end cap is formed of plastic identical to that used in making the handle. The end cap is capable of threadable engagement with the threaded interior 24 of the distal end 16 of the handle. The switch has a contact tip 68 that projects from a bottom portion 72 of the cap. The switch has a contact strip 74 that extends therefrom and into the end cap as shown in FIG. 4. The contact strip of the switch has a contact end along a shell 78 of the end cap.

The end cap 64 is threadably coupled with the handle to allow the contact tip to be in contact with a battery 82, as shown in FIG. 4. The battery is positioned within the torque handle. The end cap has a plurality of grooves 30 that are in alignment with the grooves of the handle when the cap is positioned on the handle.

Furthermore, as seen in FIG. 4, the contact strip of the cap is flush with the contact end of the conductive strip of the handle. The contact strip 74 of the cap is in contact with the conductive strip of the handle for passage of a current through and to the lamp 54. The current is passed through each of the strips when the switch is turned on by pushing a switch button 80, as seen in FIG. 1. The switch button, when pushed, allows the battery and the lamp to be in electrical contact for illumination of the lamp. Whereby, light passes from the handle, down the passage way 46 of the driver shaft, and through the nut driver. The driver shaft is formed of the same plastic used to create the handle. The light illuminates from the passage way along the length of the driver shaft, as shown in FIG. 1.

The present invention is an illuminating nut driver that has a plastic handle and a plastic driver shaft. The handle is hollow and includes a battery with a light mechanism inside. The battery is enclosed within the handle by an end cap that has a switching mechanism. The lamp in the handle is activated by turning the switch on and off by pushing the button. The handle of the invention is capable of holding one C size battery therein. The driver shaft of the present invention can be formed in various lengths and with various nut driver ends. The driver shaft is constructed of metal and directs the light directly onto the work area.

If the driver shaft is constructed of plastic, the plastic allows the light pass through the passage way of the driver shaft and along the length of the driver shaft. Because the handle itself is made of plastic that allows light passage, light comes from two sources when the device is being used. The first source is through the shaft itself and out the end of the nut driver similar to a spotlight. The second source is from the proximal end of the torque handle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved illuminating nut driver for lighting the area of nut placement comprising in combination:

a hollow torque handle having a distal end, a proximal end and a middle portion, the distal end having a threaded interior, the proximal end having an opening with a key way therein, the torque handle having a circular cross section, the handle having a plurality of linearly extending grooves for enhancing the gripping capabilities of the handle;

a hollow driver shaft having a cylindrical nut driver at a first end and a key member at a second end, the nut driver and the key member being integral with the shaft, the key member of the driver shaft configured for coupling with the key way of the torque handle for being locked therein, the driver shaft having been locked within the torque handle and being axially relative to the handle for use;

a lamp receptacle being positioned within the torque handle near the proximal end, the lamp receptacle having a lamp detachably mounted therein, the lamp receptacle having a conductive strip positioned therein and in contact with the lamp, the conductive strip extending along an interior of the torque handle with a contact end at the distal end of the handle;

a generally cylindrical end cap having a switch contained therein, the end cap configured for threadably engaging with the threaded interior of the distal end of the handle, the switch having a contact tip projecting from a top portion of the cap, the switch having a contact strip extending therefrom and into the end cap, the contact strip of the switch having a contact end along a shelf of the end cap, the cap being threadably coupled with the handle allowing the contact tip to be in contact with a battery being positioned within the torque handle; and the contact strip of the cap being flush with the contact end of the conductive strip of the handle, the contact strip of the cap being in contact with the conductive strip of the handle for the passage of a current through to the lamp, the current being passed when the switch being turned on by pushing a switch button on the cap, the switch button being pushed allows the battery and the lamp to be in electrical contact for illumination of the lamp, whereby light passes from the handle down the driver shaft and through the nut driver.

2. An illuminating nut driver comprising:

a handle having a distal end with a threaded interior, a proximal end with an opening having a key way and a middle portion therebetween;

a driver shaft having a nut driver at a first end and a key member at a second end configured for coupling with the key way of the handle for being locked therein, the driver shaft being hollow with the nut driver and the key member being integral with the shaft, and the driver shaft having been locked within the handle and axially relative to the handle for use, a lamp receptacle having a lamp detachably mounted thereto and being positioned within the handle near the proximal end;

a conductive strip being positioned along an interior of the handle and the receptacle, and being in contact with the lamp; and an end cap having a switch with a switch button and configured for threadably engaging with the threaded interior of the distal end of the handle, the end cap encapsulating a battery within the handle, the switch having a contact strip being in electrical contact with the conductive strip within the handle, electrical contact between each of the strips allow the battery and the lamp to be in electrical contact for illumination of the lamp.

3. The illuminating nut driver as set forth in claim 2, wherein the conductive strip within the handle being adjacent the lamp and having a contact end at the distal end of the handle, the contact end of the conductive strip being in electrical contact with a contact end of the contact strip of the switch, the contact end of the switch being within the end cap and along a shelf of the end cap.

4. The illuminating nut driver as set forth in claim 3, wherein the contact strip within the cap being flush with the contact end of the conductive strip of the handle, the contact strip of the cap being in contact with the conductive strip of the handle for the passage of a current therethrough and to the lamp when the switch being turned on by pushing the switch button, engaging the switch for activating the lamp will allow light passing from the handle to travel down the driver shaft and through the nut driver.

* * * * *